US007958880B1

(12) United States Patent
Mashburn

(10) Patent No.: US 7,958,880 B1
(45) Date of Patent: Jun. 14, 2011

(54) PORTABLE BATTING DEVICE AND METHOD

(75) Inventor: Benny Donald Mashburn, Lafayette, LA (US)

(73) Assignee: Batter's Dream, LLC, Lafayette, LA (US)

( * ) Notice: Subject to any disclaimer, the term of this patent is extended or adjusted under 35 U.S.C. 154(b) by 0 days.

(21) Appl. No.: 12/712,605

(22) Filed: Feb. 25, 2010

(51) Int. Cl.
*F41B 11/00* (2006.01)
*A63B 69/00* (2006.01)

(52) U.S. Cl. ..... 124/65; 473/451

(58) Field of Classification Search ..... 124/61, 124/63, 64, 65, 16; 473/451
See application file for complete search history.

(56) References Cited

U.S. PATENT DOCUMENTS 2,087,575 A * 7/1937 Littell et al. ..... 473/436
2,664,077 A 12/1953 Moore
2,705,003 A 3/1955 Schensted
2,976,041 A 3/1961 White
3,080,859 A * 3/1963 Benkoe ..... 124/64
3,489,411 A 1/1970 Morelli
3,545,752 A 12/1970 Hill et al.
3,599,978 A * 8/1971 Sondergaard ..... 273/394
3,627,319 A * 12/1971 Van Skyhawk ..... 124/16
3,856,300 A * 12/1974 Payne ..... 124/16
3,883,138 A 5/1975 Chorey
3,911,888 A * 10/1975 Horvath ..... 124/56
4,129,110 A * 12/1978 Kubrak ..... 124/16
4,220,331 A * 9/1980 Smith ..... 473/436
4,227,691 A 10/1980 Lefebvre et al.
4,383,686 A 5/1983 Cardieri
4,445,685 A 5/1984 Cardieri
4,709,924 A 12/1987 Wilson et al.
4,830,371 A 5/1989 Lay
4,865,318 A * 9/1989 Lehmann et al. ..... 124/16
4,938,478 A 7/1990 Lay
4,946,164 A * 8/1990 Fuller et al. ..... 473/418
5,221,081 A 6/1993 Rooks
5,415,396 A 5/1995 Huang
5,417,196 A * 5/1995 Morrison et al. ..... 124/6
5,575,482 A 11/1996 Butler, Jr.
5,590,876 A 1/1997 Sejnowski
5,597,160 A 1/1997 Mims
5,746,670 A * 5/1998 Brady ..... 473/451
5,800,288 A 9/1998 Mims
5,848,945 A 12/1998 Miller et al.
5,967,910 A 10/1999 Lin
6,146,289 A 11/2000 Miller et al.
6,176,230 B1 * 1/2001 Thompson ..... 124/16

(Continued)

OTHER PUBLICATIONS

International Search Report PCT/US11/25904.

(Continued)

*Primary Examiner* — Troy Chambers
(74) *Attorney, Agent, or Firm* — Jones Walker

(57) ABSTRACT

A portable batting device that includes a housing, a pneumatically operated ball launching assembly partially disposed within the housing, and a funnel-shaped ball capturing assembly positioned on the top side of the housing. The launching assembly launching a first ball upward into a hitting zone so that a batter may attempt to hit the first ball with a bat. The hitting zone is at a predetermined and adjustable vertical height. The ball capturing assembly receives the first ball should the batter swing the bat and not hit the ball and funnels the first ball into position for a subsequent launch by the launching assembly. The batting device may have a ball feeding assembly operatively associated with the ball capturing assembly.

20 Claims, 4 Drawing Sheets

U.S. PATENT DOCUMENTS

| | | | | |
|---|---|---|---|---|
| 6,398,671 | B1 | 6/2002 | Rios | |
| 6,443,859 | B1 * | 9/2002 | Markin | 473/451 |
| 6,551,204 | B1 | 4/2003 | Di Re | |
| 6,599,164 | B1 * | 7/2003 | Gerwitz et al. | 446/168 |
| 6,620,064 | B2 * | 9/2003 | Nickerson | 473/431 |
| 6,684,872 | B2 | 2/2004 | Kao et al. | |
| 6,719,649 | B1 | 4/2004 | Lin | |
| 6,884,185 | B2 | 4/2005 | Udwin et al. | |
| 6,926,623 | B2 | 8/2005 | Lin | |
| 7,028,682 | B1 | 4/2006 | Hansen | |
| 7,156,761 | B2 * | 1/2007 | Mesa | 473/451 |
| 7,204,769 | B2 | 4/2007 | Bandimere et al. | |
| 7,226,372 | B2 | 6/2007 | Flanigan | |
| 7,278,934 | B2 * | 10/2007 | McBride et al. | 473/451 |
| 7,861,699 | B2 * | 1/2011 | Gowan et al. | 124/32 |
| 2003/0032506 | A1 | 2/2003 | Chi | |
| 2003/0036446 | A1 | 2/2003 | Udwin et al. | |
| 2003/0069092 | A1 | 4/2003 | Gowan et al. | |
| 2006/0199672 | A1 | 9/2006 | Flanigan | |
| 2006/0258485 | A1 | 11/2006 | Bandimere et al. | |
| 2007/0142131 | A1 * | 6/2007 | McBride et al. | 473/451 |
| 2008/0223350 | A1 * | 9/2008 | Mahany | 124/56 |

OTHER PUBLICATIONS

Written Opinion PCT/US11/25904.

* cited by examiner

PORTABLE BATTING DEVICE AND METHOD

FIELD OF THE INVENTION

The present invention relates to a portable batting device and method, and more particularly, to a portable batting device and method that launches a ball to a predetermined height within a hitting zone.

BACKGROUND OF THE INVENTION

Ball launching mechanisms or ejectors have been used for practicing many sports, including baseball, softball, volleyball, tennis, and soccer. For example, a volleyball launcher is disclosed in U.S. Pat. No. 5,575,482 by Bill Butler, Jr. The volleyball launcher includes a housing, a ball cradle, a lift rod, a cross bar and two propelling arms. The propelling arms are actuated by a stored energy mechanism. Movement of the propelling arms generates a launch impulse from a lift rod which propels a volleyball upwards.

A ball tossing device is disclosed in U.S. Pat. No. 5,590,876 by Joseph P. Sejnowski. The ball tossing device includes a base and a tossing mechanism. The tossing mechanism includes a foot pedal for manual operation and a remote release pedal for remote operation. The tossing mechanism also includes a launching tube, a launching member, a timer, and a batting tee. Depression of either pedal compresses a spring and retracts the launching member downwardly from the launching tube. Again depressing the same pedal causes the launching member to rapidly move upwardly, engaging a ball positioned in the launching tube, and tossing the ball.

A machine for practicing baseball batting is disclosed in U.S. Pat. No. 6,684,872 by Chien-Wen Kao and Yao-Hui Tang. The practicing machine includes a base and a popping device. The popping device includes a loading stand, a suspending stand, an accommodating chamber, a pressure cylinder, and a spring. The pressure cylinder and the spring are disposed within the loading stand. The accommodating chamber is disposed above the loading stand. The suspending stand supports the pressure cylinder. A baseball positioned in the accommodating chamber is launched vertically by actuation of the pressure cylinder and the spring.

The prior-art ball launching mechanism are relatively complicated in design, expensive to manufacture, and not easily transportable or usable. There is a need for a ball launching device that is economical to manufacture, portable, and easy to use.

SUMMARY OF THE INVENTION

It is an object of the present invention to provide a batting device that is economical to make.

It is a further object of the present invention to provide a batting device that is easy to operate.

It is a further object of the present invention to provide a batting device that is self-contained and portable.

It is a further object of the present invention to provide a batting device and method capable of vertically launching a ball to a predetermined adjustable height within a hitting zone.

It is a further object of the present invention to provide a batting device capable of capturing a launched ball that a batter attempts to hit with a bat but fails and positioning the captured ball for re-launching.

It is a further object of the present invention to provide a batting device capable of sensing the absence of a ball from the launching means and automatically feeding another ball to the launching means for launching.

These and other objects and advantages are achieved by the novel portable batting device and method described herein. In one embodiment of the present invention, the portable batting device may include a housing. The housing may have a top side, a bottom side, four side wall interconnecting the top and bottom sides, and an interior compartment. The batting device may also include a pneumatically operated ball launching assembly. The launching assembly may be partially disposed with the interior compartment of the housing. The launching assembly may be capable of launching a first ball upward into a hitting zone so that a batter may attempt to hit the first ball with a bat. The hitting zone may be at a predetermined and adjustable vertical height. The batting device may also include a funnel-shaped ball capturing assembly. The capturing assembly may be positioned on the top side of the housing. The capturing assembly may be capable of both receiving the first ball should the batter swing the bat and not hit the first ball and thereafter funneling the first ball into position for a subsequent launch by the launching assembly.

The launching assembly may include an air compressor, a flow regulator, an air valve, an air accumulator, and a piston, which are all in fluid communication. Actuation of the piston may cause the first ball to be launched into the hitting zone.

The batting device may also include a control system for actuating the piston. The control system may be capable of selectively controlling the duration of the actuation of the piston to launch the first ball and a plurality of subsequent balls and selectively controlling the vertical height of the first ball and the plurality of subsequent balls within the hitting zone. The control system may also be capable of selectively disabling actuation of the piston for a period of time.

The capturing assembly may be detachably positioned on the top side of the housing. The capturing assembly may include an upper circular frame, a lower circular frame, a plurality of support bars interconnecting the upper and lower circular frames, and a ball funneling member extending between the upper and lower circular frames. The upper and lower circular frames may have a common central axis defining a launching path for the first ball when launched by the launching assembly. The ball funneling member may be a net. The plurality of support bars may be each affixed to a base plate having a central opening. The base plate may be positioned on the top side of the housing with the central opening surrounding a launching end of the launching assembly that extends external of the top side of the housing. The launching end of the launching assembly may be adapted to retain the first ball in a launching position.

The launching assembly may include a ball retaining member surrounding the launching end of the launching assembly. The ball retaining member may be affixed to the top side of the housing and retain the first ball in the launching position.

The batting device may also include a ball feeding assembly operatively associated with the ball capturing assembly. The ball feeding assembly may selectively deliver a second ball into the ball capturing assembly when the first ball has been hit by the batter. The funneling member of the ball capturing assembly may funnel the second ball into the launching position on the ball retaining member for launching by the launching assembly.

The batting device may further include a sensor operatively connected to the ball retaining member and operatively associated with the ball feeding assembly. The sensor may detect whether or not the ball retaining member is retaining the first ball. When the sensor detects that the ball retaining member has not retained the first ball for a predetermined amount of time, the sensor may signal the ball feeding assembly to deliver the second ball into the ball capturing assembly.

The batting device may also include a battery. The battery may supply power to operate the device.

In an alternative embodiment, the portable batting device may include a housing having a top side, a bottom side, four side walls interconnecting the top and bottom sides, and an interior compartment. The batting device may also include a pneumatically operated ball launching assembly partially disposed within the interior compartment of the housing. The launching assembly may be capable of launching a first ball upward from a launching position into a hitting zone so that a batter may attempt to hit the first ball with a bat. The hitting zone may be at a predetermined and adjustable vertical height. The device may also contain a funnel-shaped ball capturing assembly positioned on the top side of the housing. The capturing assembly may be capable of both receiving the first ball should the batter swing the bat and not hit the first ball and thereafter funneling the first ball into position for a subsequent launch by the launching assembly. The ball capturing assembly may include an upper circular frame, a lower circular frame, a plurality of support bars interconnecting the upper and lower circular frames, and a ball funneling member extending between the upper and lower circular frames. The batting device may further include a ball feeding assembly operatively associated with the ball capturing assembly. The ball feeding assembly may selectively deliver a second ball into the ball capturing assembly when the first ball has been hit by the batter. The ball funneling member of the ball capturing assembly may funnel the second ball into the launching position for launching by the ball launching assembly.

In the alternative embodiment, the ball feeding assembly may include a ramp and a selective retaining pin operatively attached to the ramp near the end of the ramp in operative association with the ball capturing assembly. The selective retaining pin may selectively deliver the second ball into the ball capturing assembly. The ball feeding assembly may further include a ball counter.

The method of the present invention for vertically launching balls for batting may includes the step of providing a portable batting device. The portable batting device may contains a housing having a top side, a bottom side, four side walls interconnecting the top and bottom sides, and an interior compartment; a pneumatically operated ball launching assembly partially disposed within the interior compartment of the housing; and a funnel-shaped ball capturing assembly positioned on the top side of the housing. The method may include the step of activating the ball launching assembly. The method may also include the step of launching a first ball upward from a launching position of the ball launching assembly into a hitting zone so that a batter may attempt to hit the first ball with a bat. The hitting zone may be at a predetermined and adjustable vertical height. The method also may include the step of capturing the first ball in the ball capturing assembly should the batter swing the bat and not hit the first ball. The method may also include the step of funneling the first ball into the launching position with the ball capturing assembly for a subsequent launch by the ball launching assembly.

The method may also include the step of detecting whether or not the first ball is retained in the launching position with a ball sensor. Should the ball sensor detect the presence of the first ball in the launching position, the method may include the step of vertically launching the captured first ball again from the launching position. Should the ball sensor detect the absence of the first ball in the launching position after a predetermined amount of time, the method may include the step of delivering a second ball from a ball feeding assembly into the ball capturing assembly and the step of funneling the second ball into the launching position for launching by the ball launching assembly.

DETAILED DESCRIPTION OF THE PREFERRED EMBODIMENTS

Figure 1:
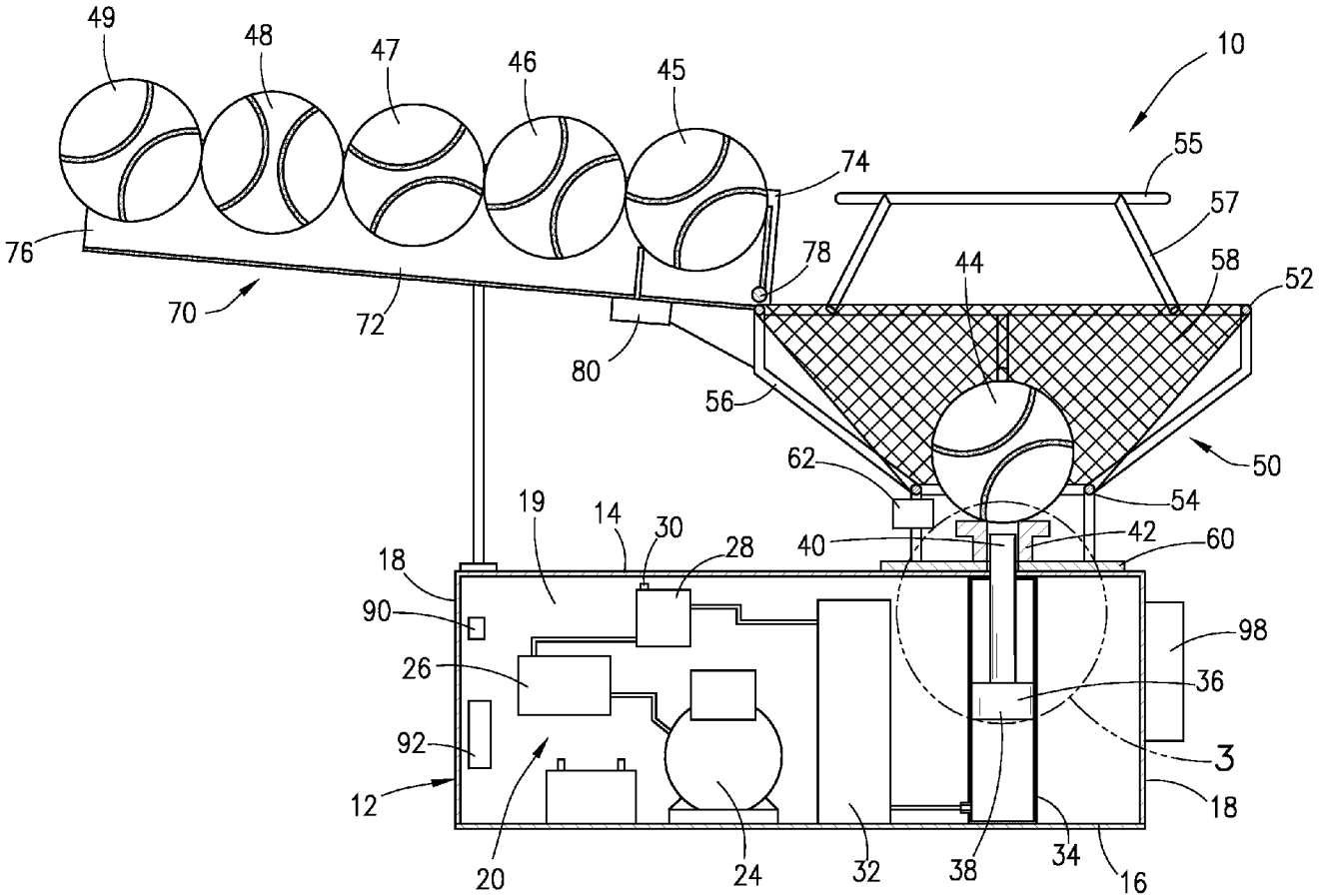
FIG. 1 is a cross-sectional view of an embodiment of the batting device of the present invention.

Like elements have been given like numerical designation in the figures described below to facilitate an understanding of the present invention. With reference to the embodiments illustrated in FIGS. 1-2, portable batting device 10 may include housing 12. Housing 12 may have top side 14, bottom side 16, side walls 18 that interconnect top side 14 and bottom side 16, and interior compartment 19. Pneumatically operated ball launching assembly 20 may be partially disposed within interior compartment 19 of housing 12. Launching assembly 20 may launch ball 44 (e.g., T-ball, baseball, softball) upward into hitting zone 22 (shown in FIG. 4) so that a batter may attempt to hit ball 44 with a bat or other hitting instrument (e.g., T-ball bat, baseball bat, softball bat). Hitting zone 22 may be a predetermined and adjustable vertical height selected based on a number of factors such as the height of the batter or the height from the batter's knees and chest. Funnel-shaped ball capturing assembly 50 may be positioned on top side 14 of housing 12. Capturing assembly 50 receives ball 44 that the batter has swung at but missed hitting with the bat and thereafter funnels the ball into position for subsequent launch by launching assembly 20.

Figure 3:
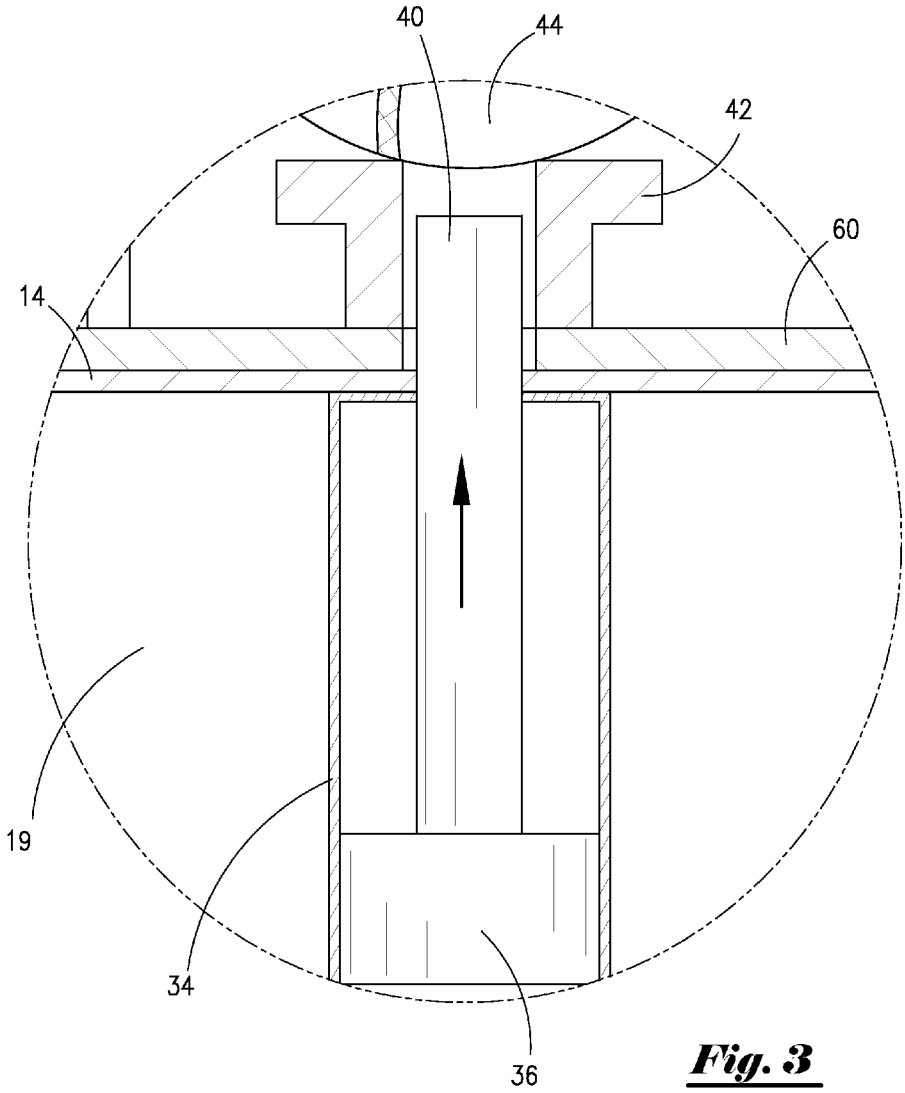
FIG. 3 is a partial cross-sectional view of the batting device illustrated in FIG. 1.

As seen in FIG. 1, launching assembly 20 may include air compressor 24, flow regulator 26, solenoid air valve 28, air exhaust 30, air accumulator 32, cylinder 34, and piston 36, all in fluid communication. Piston 36 may be positioned within cylinder 34. Piston 36 may have proximate end 38 and distal end 40. Distal end 40 of piston 36 may be the launching end of the launching assembly that extends external of top side 14 of housing 12 and contacts ball 44 in a launching position to launch ball 44 upward into hitting zone 22. Launching assembly 20 may also include ball retaining member 42 for supporting ball 44 in the launching position. As shown in FIG. 3, distal end 40 of piston 36 (i.e., the launching end of the launching assembly) may extend through an opening in ball retaining member 42 to the ball launching position at the upper surface of ball retaining member 42. In an alternate embodiment, the launching end of the launching assembly may be integrated with the ball retaining member such that the integral part is capable of moving to launch ball 44.

Figure 2:
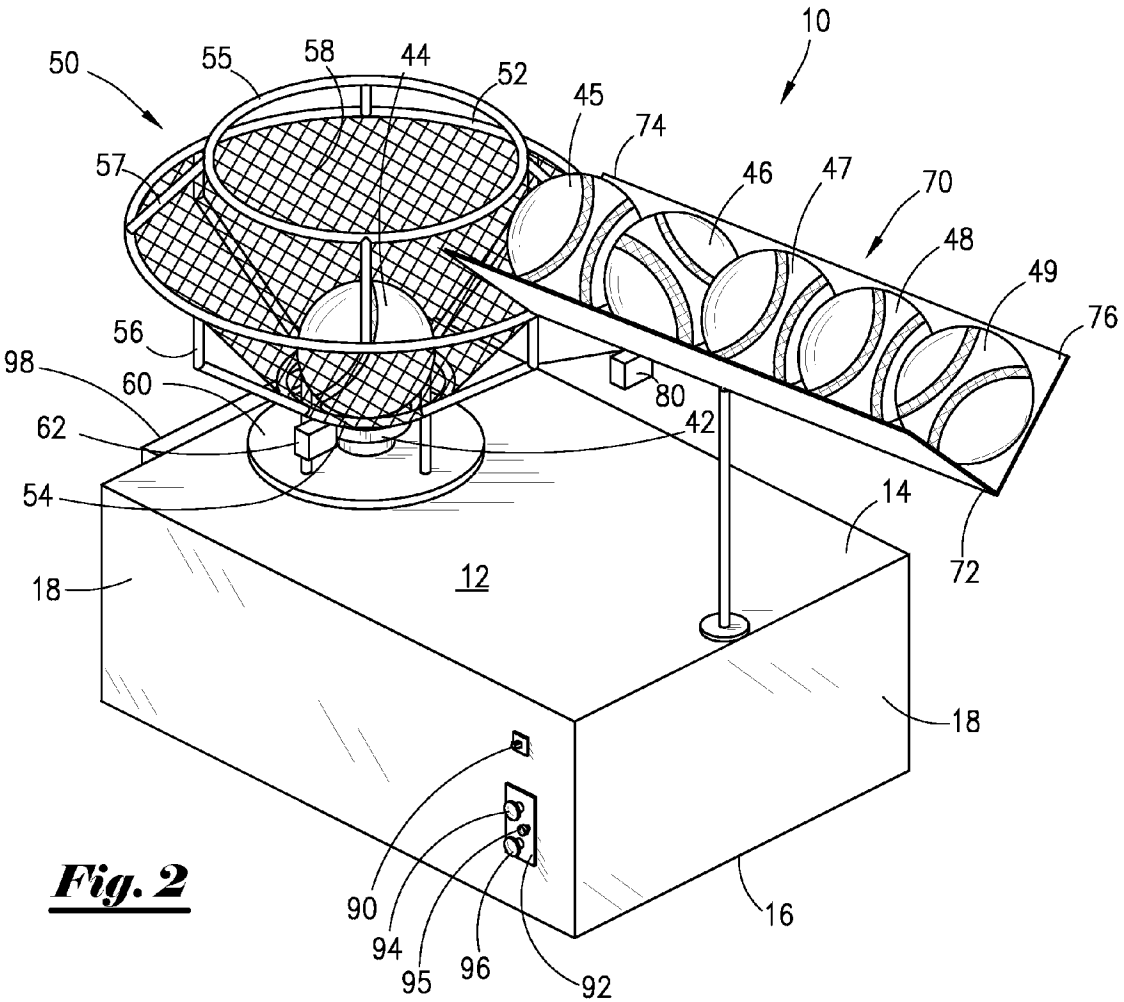
FIG. 2 is a perspective view of the batting device illustrated in FIG. 1.

Referring again to FIGS. 1-2, capturing assembly 50 may include upper circular frame 52, lower circular frame 54, plurality of support bars 56, and ball funneling member 58 extending from upper circular frame 52 to lower circular frame 54. Plurality of support bars 56 may each be affixed to base plate 60 positioned on top side 14 of housing 12. Plurality of support bars 56 may each be straight or have one or more bends. Base plate 60 may have a central opening through which the launching end of the launching assembly extends. Ball funneling member 58 may be formed of a net attached to upper circular frame 52 and lower circular frame 54 as shown in FIGS. 1-2. Alternatively, ball funneling member 58 may be formed of upper surfaces of the plurality of support bars 56 alone (with no net) spaced such that a ball will not fit between two of support bars 56. Capturing assembly 50 may also include retaining frame 55 positioned above upper circular frame 52 and supported by plurality of retaining bars 57 connected to upper circular frame 52 and retaining frame 55.

Batting device 10 may also include ball sensor 62. Ball sensor 62 may be positioned proximate to ball retaining member 42. Ball sensor 62 may detect whether or not ball retaining member 42 is retaining a ball (e.g., ball 44). Ball sensor 62 may be an infrared light source mounted on one side of ball retaining member 42 and a corresponding light detector on the opposite side of ball retaining member 42.

Referring again to FIGS. 1-2, batting device 10 may also include ball feeding assembly 70. Ball feeding assembly 70 may include ramp 72, selective retaining pin 78, and ball counter 80. Ramp 72 may have proximate end 74 and distal end 76. Proximate end 74 of ramp 72 may be positioned over upper circular frame 52 of capturing assembly 50. Selective retaining pin 78 may be positioned at proximate end 74 of ramp 72. A plurality of balls (e.g., second ball 45, third ball 46, fourth ball 47, fifth ball 48, and sixth ball 49) may be supported by ramp 72. Ramp 72 may support fifty or more balls at once. Selective retaining pin 78 may prevent the plurality of balls from rolling into the capturing assembly 50 until desired. Ball counter 80 may count as each of the plurality of balls rolls over it on ramp 72.

Batting device 10 may further include battery 98. Battery 98 may be capable of powering batting device 10 such that it may be used outdoors without the use of an extension cord. Battery 98 may be positioned on one of side walls 18 of housing 12 as shown in FIGS. 1-2, on top side 14 of housing 12, or within interior compartment 19 of housing 12.

Batting device 10 in FIGS. 1-2 may also include a control system. The control system may include power switch 90 and switch box 92 positioned on side walls 18 of housing 12. Switch box 92 may include speed control 94, pause switch 95 and duration control 96. To initiate activation of device 10, power switch 90 may be switched to an "on" position. Speed control 94 may control the frequency of launching ball 44. Duration control 96 may control the length of time over which device 10 continues launching ball 44. Activation of pause switch 95 may prevent device 10 from launching ball 44 until pause switch 95 is deactivated. This may allow a user to stop device 10 from launching ball 44 without switching off power switch 90.

Power switch 90 may be composed of any type of on/off switch. Speed control 94 and duration control 96 may be composed of any type of switch, including proximity switches. Pause switch 90 may be a remotely controlled switch and device 10 may also include a remote control for activating the remotely controlled pause switch 90. Device 10 may also include a computer chip for electronically activating or adjusting the setting of power switch 90, speed control 94, duration control 96, and pause switch 90.

Engaging power switch 90 illustrated in FIGS. 1-2 may activate air compressor 24. Air compressor 24 may generate air pressure. The flow of compressed air through a tubular system (e.g., hoses or conduits) in launching assembly 20 may be controlled by flow regulator 26 and solenoid air valve 28. Compressed air may flow into air accumulator 32. When the air pressure in air accumulator 32 reaches a pressure greater than atmospheric pressure, compressed air may expand in cylinder 34. The expansion of air in cylinder 34 may vertically displace piston 36. As piston 36 is vertically displaced, distal end 40 of piston 36 travels through the central opening in base plate 60 and through the opening in ball retaining member 42. Distal end 40 of piston 36 vertically launches ball 44 as distal end 40 contacts ball 44 at the launching position (on the upper surface of ball retaining member 42). Device 10 may also include mechanism for controlling the height to which ball 44 is launched. This height control may be a valve that adjusts the amount of air flowing to cylinder 34, which in turn adjusts the height to which ball 44 is launched. Duration control 96 may be adjusted to control the duration of actuation of piston 36.

Batting device 10 may be configured to eject any type of ball that is capable of being hit with a bat such as baseballs, softballs, T-balls, etc. By way of example, the operation of device 10 illustrated in FIGS. 1-2 will now be discussed with reference to ejecting baseballs or softballs. The present invention is not limited to this operation.

Figure 4:
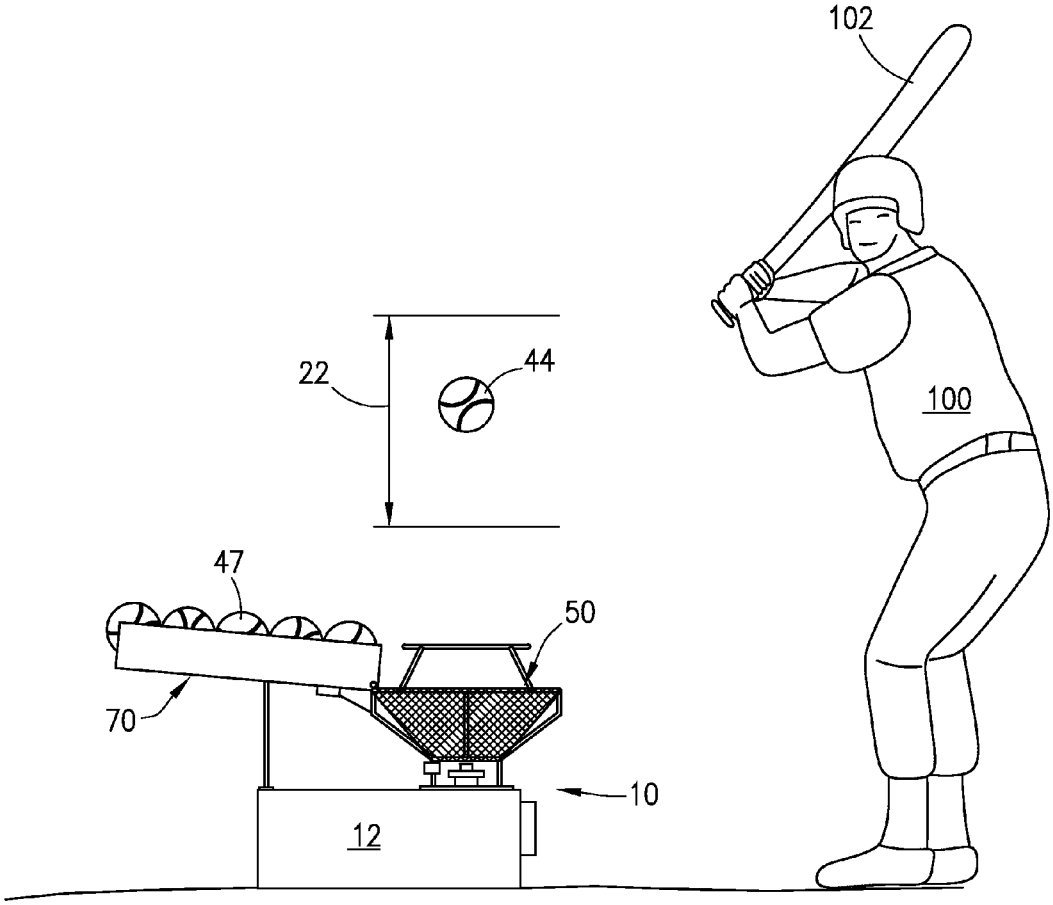
FIG. 4 is a perspective view of the batting device and a batter holding a bat.

Referring now to FIG. 4, batter 100 or any other person may first engage power switch 90, activating air compressor 24 in interior compartment 19 of housing 12. Compressed air may then flow through the tubular system of ball launching assembly 20 into air accumulator 32. Air pressure may build in air accumulator 32. Compressed air may expand into cylinder 34. Piston 36 may be vertically displaced by air expanding in cylinder 34. Distal end 40 of piston 36 may vertically launch ball 44 resting on ball retaining member 42.

Batter 100 may swing bat 102 attempting to hit launched ball 44 in hitting zone 22. If bat 102 does not hit ball 44 while in the air and ball 44 is not otherwise disturbed in its vertical path, ball 44 may fall into capturing assembly 50 due to the force of gravity. Once within assembly 50, ball 44 may roll down ball funneling member 58 and may come to rest in the launch position on ball retaining member 42. Retaining frame 55 and plurality of retaining bars 57 may prevent ball 44 from bouncing out of ball funneling member 58. Ball sensor 62 may detect that ball retaining member 42 is retaining ball 44. Ball 44 may be launched again upon the next actuation of launching assembly 20.

If bat 102 hits ball 44 while in hitting zone 22 or otherwise, or if ball 44 is otherwise disturbed in its vertical path such that ball 44 does not fall into capturing assembly 50, ball sensor 62 may detect that ball retaining member 42 is not retaining a ball in the launch position. After a predetermined time, ball sensor 62 may signal selective retaining pin 78 of ball feeding assembly 70 to release second ball 45 from ramp 72 and into capturing assembly 50. Second ball 45 may roll down ball funneling member 58 and may come to rest in the launch position on ball retaining member 42. As second ball 45 rolls down ball retaining member 42, third ball 46 may roll past ball counter 80 which counts third ball 46. Upon the next activation of launching assembly 20, second ball 45 may be launched from the launching position.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. A portable batting device, comprising:

a housing having a top side, a bottom side, four side walls interconnecting the top and bottom sides, and an interior compartment;

a pneumatically operated ball launching assembly partially disposed within the interior compartment of the housing, the launching assembly capable of launching a first ball upward into a hitting zone so that a batter may attempt to hit the first ball with a bat, the hitting zone being at a predetermined and adjustable vertical height; and a funnel-shaped ball capturing assembly positioned on the top side of the housing, the ball capturing assembly capable of both receiving the first ball should the batter swing the bat and not hit the first ball and thereafter funneling the first ball into position for a subsequent launch by the launching assembly.

2. The portable batting device according to claim 1, wherein the launching assembly includes an air compressor, a flow regulator, an air valve, an air accumulator, and a piston all in fluid communication; and wherein actuation of the piston causes the launching of the first ball.

3. The portable batting device according to claim 2, further comprising a control system for actuating the piston, the control system capable of selectively controlling the duration of actuation of the piston to launch the first ball and a plurality of subsequent balls and selectively controlling the vertical height of the first ball and the plurality of subsequent balls within the hitting zone, said control system capable of selectively disabling actuation of the piston.

4. The portable batting device according to claim 1, wherein the ball capturing assembly is detachably positioned on the top side of the housing.

5. The portable batting device according to claim 4, wherein the ball capturing assembly includes an upper circular frame, a lower circular frame, a plurality of support bars interconnecting the upper and lower circular frames, and a ball funneling member extending between the upper and lower circular frames, the upper and lower circular frames having a common central axis defining a launching path for the first ball when launched by the launching assembly.

6. The portable batting device according to claim 5, wherein the ball capturing assembly further includes a retaining frame and a plurality of retaining bars interconnecting said upper circular frame and said retaining frame, the retaining frame having a common central axis with said upper and lower circular frames.

7. The portable batting device according to claim 5, wherein the ball funneling member is a net.

8. The portable batting device according to claim 5, wherein the ball funneling member is formed of said plurality of support bars.

9. The portable batting device according to claim 5, wherein the plurality of support bars are each affixed to a base plate having a central opening, the base plate being positioned on the top side of the housing with the central opening surrounding a launching end of the launching assembly that extends external of the top side of the housing.

10. The portable batting device according to claim 9, wherein the launching end of the launching assembly is adapted to retain the first ball in a launching position.

11. The portable batting device according to claim 10, wherein the launching assembly includes a ball retaining member surrounding the launching end of the launching assembly, the ball retaining member being affixed to the top side of the housing and retaining the first ball in the launching position.

12. The portable batting device according to claim 11, further comprising a ball feeding assembly operatively associated with the ball capturing assembly, the ball feeding assembly selectively delivering a second ball into the ball capturing assembly when the first ball has been hit by the batter, the funneling member of the ball capturing assembly funneling the second ball into the launching position on the ball retaining member for launching by the launching assembly.

13. The portable batting device according to claim 12, further comprising a sensor operatively connected to the ball retaining member and operatively associated with the ball feeding assembly, the sensor detecting whether or not the ball retaining member is retaining the first ball; and wherein when the sensor detects that the ball retaining member has not retained the first ball for a predetermined amount of time, the sensor signals the ball feeding assembly to deliver the second ball into the ball capturing assembly.

14. The portable batting device according to claim 1, further comprising a battery; and wherein the battery supplies power to operate the device.

15. A portable batting device, comprising:

a housing having a top side, a bottom side, four side walls interconnecting the top and bottom sides, and an interior compartment;

a pneumatically operated ball launching assembly partially disposed within the interior compartment of the housing, the launching assembly capable of launching a first ball upward from a launching position into a hitting zone so that a batter may attempt to hit the first ball with a bat, the hitting zone being at a predetermined and adjustable vertical height;

a funnel-shaped ball capturing assembly positioned on the top side of the housing, the ball capturing assembly capable of both receiving the first ball should the batter swing the bat and not hit the first ball and thereafter funneling the first ball into position for a subsequent launch by the launching assembly, the ball capturing assembly comprising: an upper circular frame, a lower circular frame, a plurality of support bars interconnecting the upper and lower circular frames, and a ball funneling member extending between the upper and lower circular frames; and a ball feeding assembly operatively associated with the ball capturing assembly, the ball feeding assembly selectively delivering a second ball into the ball capturing assembly when the first ball has been hit by the batter, the ball funneling member of the ball capturing assembly funneling the second ball into the launching position for launching by the ball launching assembly.

16. The portable batting device of claim 15, wherein the ball capturing assembly further comprises a retaining frame and a plurality of retaining bars.

17. The portable batting device of claim 15, wherein the ball feeding assembly comprises a ramp and a selective retaining pin operatively attached to the ramp near the end of the ramp in operative association with the ball capturing assembly, and wherein the selective retaining pin selectively delivers the second ball into the ball capturing assembly.

18. The portable batting device of claim 17, wherein the ball feeding assembly further comprises a ball counter.

19. A method of vertically launching balls for batting comprising the steps of:

(a) providing a portable batting device, said portable batting device comprising: a housing having a top side, a bottom side, four side walls interconnecting the top and bottom sides, and an interior compartment; a pneumatically operated ball launching assembly partially disposed within the interior compartment of the housing; and a funnel-shaped ball capturing assembly positioned on the top side of the housing;

(b) activating the ball launching assembly;

(c) launching a first ball upward from a launching position of the ball launching assembly into a hitting zone so that a batter may attempt to hit the first ball with a bat, the hitting zone being at a predetermined and adjustable vertical height;

(d) capturing the first ball in the ball capturing assembly should the batter swing the bat and not hit the first ball; and (e) funneling the first ball into the launching position with the ball capturing assembly for a subsequent launch by the ball launching assembly.

20. The method according to claim 19, further comprising the steps of:

(f) detecting whether or not the first ball is retained in the launching position with a ball sensor;

(g) should the ball sensor detect the presence of the first ball in the launching position, vertically launching the captured first ball again from the launching position; and (h) should the ball sensor detect the absence of the first ball in the launching position after a predetermined amount of time, delivering a second ball from a ball feeding assembly into the ball capturing assembly, and funneling the second ball into the launching position for launching by the ball launching assembly.

* * * * *